US012553297B2

(12) United States Patent
Ramaswamy

(10) Patent No.: US 12,553,297 B2
(45) Date of Patent: Feb. 17, 2026

(54) ROBUST VALVE ROD GUIDE ASSEMBLY

(71) Applicant: Q2 ARTIFICIAL LIFT SERVICES LLC, Midland, TX (US)

(72) Inventor: Santhosh Ramaswamy, Conroe, TX (US)

(73) Assignee: Q2 Artificial Lift Services LLC, Midland, TX (US)

( * ) Notice: Subject to any disclaimer, the term of this patent is extended or adjusted under 35 U.S.C. 154(b) by 0 days.

(21) Appl. No.: 18/903,259

(22) Filed: Oct. 1, 2024

(65) Prior Publication Data

US 2025/0109639 A1 Apr. 3, 2025

Related U.S. Application Data

(60) Provisional application No. 63/587,220, filed on Oct. 2, 2023.

(51) Int. Cl.
*E21B 17/10* (2006.01)
*F04B 53/14* (2006.01)

(52) U.S. Cl.
CPC ..... *E21B 17/1071* (2013.01); *F04B 53/146* (2013.01)

(58) Field of Classification Search
CPC ..... E21B 17/10; E21B 17/1071; F04B 53/146
See application file for complete search history.

(56) References Cited

U.S. PATENT DOCUMENTS

| | | | | |
|---|---|---|---|---|
| 10,184,328 | B1 | 1/2019 | Holleman | |
| 10,519,949 | B1 | 12/2019 | Hankins | |
| 2004/0011518 | A1 | 1/2004 | Skillman | |
| 2004/0018101 | A1 | 1/2004 | Mahoney | |
| 2010/0108150 | A1 | 5/2010 | Ford | |
| 2024/0167345 | A1 * | 5/2024 | Flynn | E21B 43/127 |

OTHER PUBLICATIONS

International Search Report and Written Opinion of the International Searching Authority for PCT/US2024/049403.

* cited by examiner

*Primary Examiner* — Matthew R Buck
(74) *Attorney, Agent, or Firm* — Smith Baluch LLP

(57) ABSTRACT

A valve rod guide assembly includes a unitary rod guide body having an upper end, which may have a clutch feature, and a lower end, which may have a thread feature, where an internal bore extends between both ends. A movable insert is disposed inside the internal bore which shoulders against a positive stop at the upper end of the valve rod guide housing. The movable insert is retained inside the unitary rod guide body through a retaining element fixed to a portion of the unitary rod guide body.

20 Claims, 5 Drawing Sheets

ROBUST VALVE ROD GUIDE ASSEMBLY

CROSS REFERENCE TO RELATED APPLICATIONS

This application claims the priority benefit, under 35 U.S.C. § 119(e), of U.S. Application No. 63/587,220, filed on Oct. 2, 2023, which is incorporated herein by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The present disclosure generally relates to valve rod guide assembly for use in a downhole artificial lift system of the type that may be used to remove hydrocarbons from the ground. The disclosed elements and processes, however, may have applications outside the disclosed field and this description is not intended to limit the scope of the claimed subject matter in any way.

Description of the Related Art

Downhole sucker-rod pumps are used in sucker-rod type artificial lift systems. Such systems conventionally include a number of different components including those illustrated in FIG. 1.

FIG. 1 depicts a conventional sucker-rod artificial lift system 10 that includes, a movable assembly 11 that includes a traveling valve 12; a plunger 13; a coupling plunger 14; a valve rod 16; and a valve rod bushing 17.

In the example of FIG. 1, in use, the movable assembly 11 is typically positioned within a stationary assembly 21 such that the movable assembly 11 may be stroked upwardly and downwardly within the stationary assembly 21. The movement producing the stroking may result from, for example, the coupling of the movable assembly 11 to a beam pumping unit (not illustrated in FIG. 1).

In the example of FIG. 1, a conventional stationary assembly 21 is depicted that includes a hold-down assembly (comprising elements 20*a* and 20*b*); a standing valve 22; a barrel 24; barrel connector 26; and a valve rod guide 28.

During use, movement of the movable assembly 11 within the stationary assembly 21 will result operation of a pump assemble in which: (a) typically a volume of production fluid is received within the barrel through the plunger 13 and the traveling valve 12 during each upstroke and (b) a volume of production fluid is lifted through the annulus that will exist between the inner walls of the barrel 24 and the exterior of the movable assembly 21 during each typical upstroke. Thus, in the described system, production fluid will be received within, and move within, the interior space of the barrel 24 during each upstroke.

As those of ordinary skill in the art will appreciate, one of the components of a typical sucker-rod assembly is a valve rod guide, such as valve rod guide (or valve rod guide assembly) 28 in FIG. 1. The valve rod guide assembly 28 plays an important role in the proper operation of the system in that it tends to guide the valve rod during its reciprocating motion, thus avoiding or reducing undesirable side loads, and reducing wear on the valve rod.

FIGS. 2A-2B, illustrate exemplary forms of conventional valve rod guides.

Referring to FIG. 2A, a first example of a conventional rod guide 100 is illustrated which, in use, will typically be connected to a position of a stationary barrel assembly in a downhole rod pump. In the illustrated example, the conventional valve rod guide 100 is depicted as having an internal bore 103 that extends between an upper clutch end 101 and a lower thread end 102. One purpose of the clutch end 101 is to permit a degree of rotation of the sucker rod string. The clutch can be used to disconnect the rod string in the event a pump is stuck. In this manner, rod string can be pulled out of the wellbore before the pump.

As shown in FIG. 2A, in the illustrated example, a first internal diameter 104 is formed near the upper clutch end 101 and a second internal diameter 105 is formed near the lower thread end 102; fluid exit ports 106 are formed near the lower thread end 102 which extends from the internal bore 103 through the internal diameter 105 and a neck feature 108 is provided at the location where the outside diameter 109 transitions to the outside diameter 110. As those of ordinary skill will appreciate, in use, the conventional valve guide of FIG. 2A will be used in conjunction with a valve rod (not shown) connected to a plunger (not shown) which reciprocates inside the internal bore 103 by maintaining a close tolerance with the internal diameter 104 to align the plunger (not shown) inside the barrel (not shown). The clutch feature 107 helps to disconnect the sucker rod strong in the event of sand pack during pump pull out from the downhole. The neck feature 108 is used to grab the downhole pump with an overshot fishing tool in the event of rod string failure.

A longstanding problem with conventional designs like that shown in FIG. 2A is that relative movement of the valve rod within the valve rod guide can result in undesired wear of the valve rod guide 100. This is, in part, because of the relative difference in hardness between the valve rod guide 100 and the rod moving within the valve rod guide. One known approach to attempt to address this issue is to coat or overlay one or more interior surfaces of the valve rod guide with a hard material to improve the wear resistance of the valve rod guide 100. An example of a valve rod guide attempting this approach is shown in FIG. 2B, above, which corresponds to a conventional valve rod guide of FIG. 2A to which a layer of hardened material 105 has been added. Such a layer may comprise a spray metal material such as STELLITE®.

A longstanding problem with conventional designs such as the one illustrated in FIG. 2B is that the hardened layer 105 will tend to wear in use, and the deterioration of the relatively thin layer 105, will result in undesired deterioration of the valve rod moving within the valve rod guide.

In an effort to address undesired issues associated with the use of sprayed on hardened layers, conventional approaches developed that involved the use of a hardened insert in conjunction with a multi-element valve rod guide. Examples of such conventional approaches are depicted in FIGS. 3A and 3B.

Referring first to FIG. 3A, a first conventional multi-part valve rod guide is disclosed that includes a first member 33 and a retaining collar 32. In the illustrated example of FIG. 3A, a hardened insert 30 is held between the first member 33 and the retaining collar 32.

Referring to FIG. 3B, a second conventional multi-part valve rod guide is disclosed that includes a first member 37 and a retaining collar 38. In the illustrated example of FIG. 3B, a hardened insert 36 is held between the first member 37 and the retaining collar 38. In the example of FIG. 3B, the insert 36 is not held in a fixed relationship with respect to either the first member 37 or the retaining collar 38, such that the hardened member 28 can move relative to the first member 37 and the retaining collar 38. This ability of the insert 36 to move (or float) as a valve rod moves within the illustrated valve rod guide can be beneficial during instances where the valve rod is subjected to an impact-type force (e.g., as the result of a pump tag) by absorbing some of the shock load created by such a force.

In both the conventional examples of FIGS. 3A and 3B, the hardened insert is typically harder than the metal valve rod which reciprocates inside the bore.

A longstanding problem associated with conventional multi-part valve rod guides of the type shown in FIGS. 3A and 3B is that the need to couple the respective first members to the respective retaining collars requires that the retaining collar have physical characteristics (e.g., a longitudinal length and/or outer diameter) adequate to couple the respective first members to their associated collars. Such a construction is undesirable for several reasons including that it requires the use of multiple discrete components to form the multi-part valve rod guide (resulting in increased manufacturing and component costs), and that it typically requires a collar element of a longitudinal length that is greater than the longitudinal length of easily graspable by most standard fishing tools. As a result, conventional multi-part valve rod guide assemblies can render pump fishing harder or impossible due to the standardization of overshot fishing tool.

In an effort to avoid the identified and other issues resulting from the use of a multi-part valve rod guide and the typical inability to use such guides with standard fishing tools, alternate conventional approaches were adopted in which a hardened insert was fixedly positioned within a single component valve rod guide. One example of such a conventional approach is shown in FIG. 4.

FIG. 4 shows a conventional valve rod guide assembly 40 that includes a main valve rod guide body 41 having an open upper end 44 and a hardened insert 43 positioned within the open upper end of the body 41. To maintain coupling of the insert 43 and the body 41, in known conventional valve rod guides like that illustrated in FIG. 4, the insert is fixedly coupled (e.g., through a metallurgical coupling) to a surface of an internal bore within the body 41. While conventional valve rod guide like that shown in FIG. 4 can typically accept a standard overshot fishing tool for pulling a stuck downhole pump, the fixed relationship between the insert 43 and the rod guide body 41 is such that a shock load can easily transfers to the metallurgically joined insert as the result of impacts (e.g., from downhole pump tagging) which can damage or crack the insert 43, thereby degrading the performance of the rod guide or rendering the rod guide unusable.

It is an object of the disclosure contained herein to overcome the described and other limitations of known and/or conventional approaches for enhancing the lifespan and operation of downhole pump barrels.

It is to be understood that the discussion above is provided for illustrative purposes only and is not intended to and does not limit the scope or subject matter of the appended or ultimately issued claims or those of any related patent application or patent. Thus, none of the appended claims, ultimately issued claims or claims of any related application or patent are to be limited by the above discussion or construed to address, include, or exclude each or any of the above-cited features or disadvantages merely because such were mentioned herein.

BRIEF SUMMARY OF THE INVENTION

A brief non-limiting summary of one of the many possible embodiments of the inventions disclosed herein is a valve rod guide assembly for use in a sucker-rod artificial lift system comprising: a unitary rod guide body, the unitary rod guide body defining a longitudinal bore passing therethrough, the longitudinal bore further defining a first section having a first internal diameter, a second section having a second internal diameter, and a third section having a third internal diameter, wherein the second internal diameter is greater than the first internal diameter and the third internal diameter is greater than the second internal diameter, the unitary rod guide body further comprising a first radially extending internal edge surface and a second radially extending internal edge surface; a slidable insert positioned within the second section of the longitudinal bore, wherein in the maximum outer diameter of the slidable insert is less than the minimum internal diameter of the second section of the longitudinal bore, such that the slidable insert is capable of moving longitudinally within the second section of the longitudinal bore, the longitudinal movement of the slidable insert being constrained in a first direction by the first radially extending internal edge surface; and a retention element positioned within the third section of the longitudinal bore in such a manner that relative movement between the retention element and the longitudinal bore is inhibited, the retention element being positioned such that longitudinal movement of the slidable insert in a second direction is constrained by a surface of the retention element.

Additionally or alternately, an embodiment of an invention disclosed herein can take the form of a rod guide assembly comprising: a main body formed form a single piece of machined metal, the main body having a longitudinal axis and an radial axis that is perpendicular to the longitudinal axis, the main body being machined such that it defines a longitudinal bore extending along a longitudinal axis, and a first edge surface extending radially into the longitudinal bore and a second edge surface extending into the longitudinal bore; a ring-like retaining element positioned within a portion of the longitudinal bore, the ring-like retaining element comprising a surface abutting the second edge surface, the ring-like element defining an upper surface; and an insert in the form of a tube that is positioned within the longitudinal bore in such a manner that it is movable, wherein movement of the insert in a first longitudinal direction is constrained by the first edge surface of the main body and movement of the insert in a second longitudinal direction is constrained by the upper surface of the ring-like retaining element.

None of these brief summaries of the inventions is intended to limit or otherwise affect the scope of what has been disclosed and enabled or the appended claims, and nothing stated in this Brief Summary of the Invention is intended as a definition of a claim term or phrase or as a disavowal or disclaimer of claim scope.

BRIEF DESCRIPTION OF THE SEVERAL VIEWS OF THE DRAWINGS

The following figures form part of the disclosure of inventions and are included to demonstrate further certain aspects of the inventions. The inventions may be better understood by reference to one or more of these figures in combination with the detailed description of certain embodiments presented herein in which.

Figure 1:
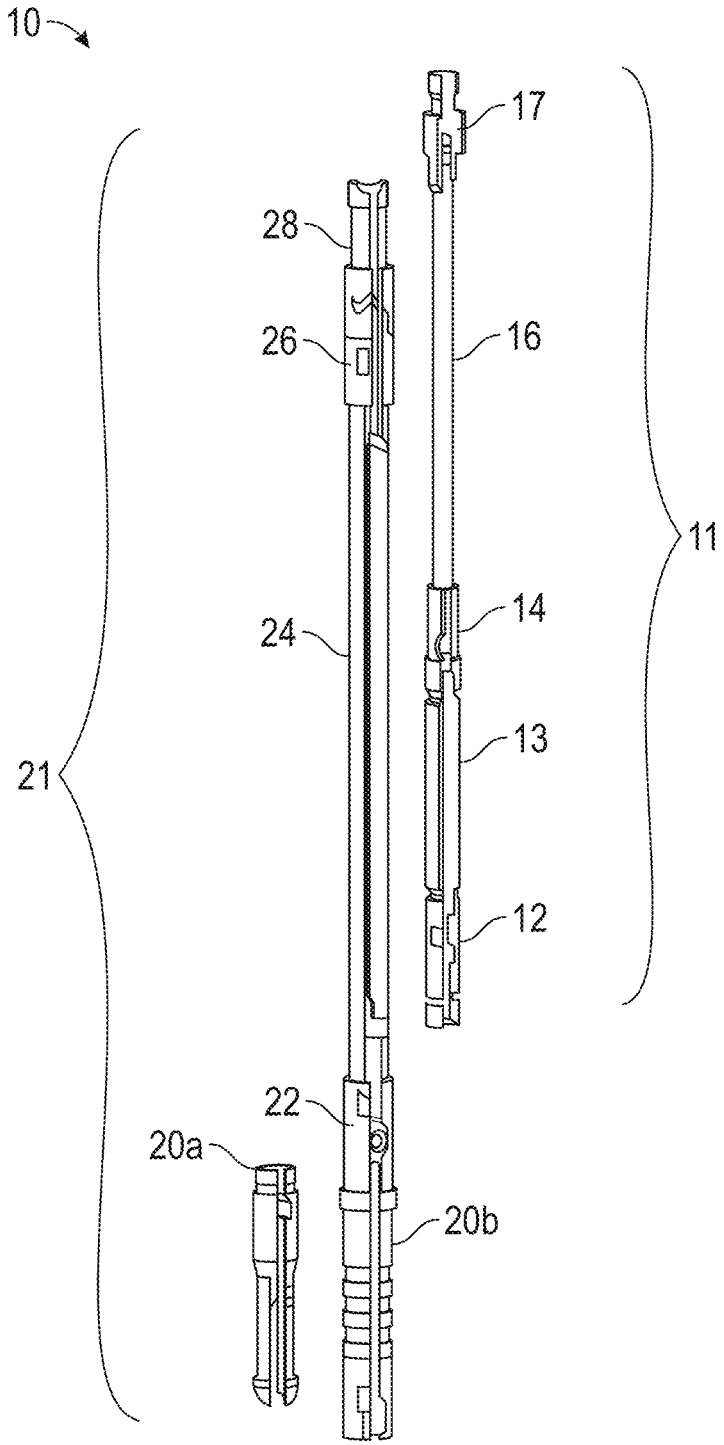
FIG. 1 depicts a conventional sucker-rod artificial lift system that includes, a movable assembly that includes a traveling valve; a plunger a coupling plunger; a valve rod and a valve rod bushing.
Figure 2A:
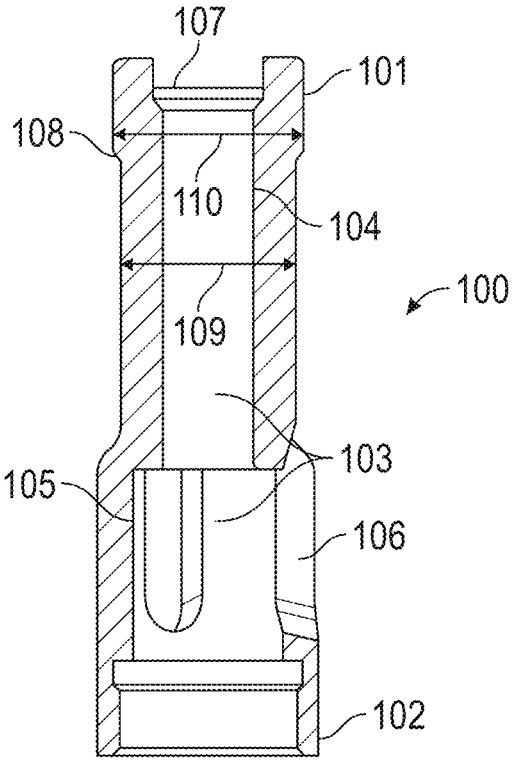
FIG. 2A (Prior Art)
FIGS. 2A-2B, below, illustrate exemplary forms of conventional valve rod guides.
Figure 2B:
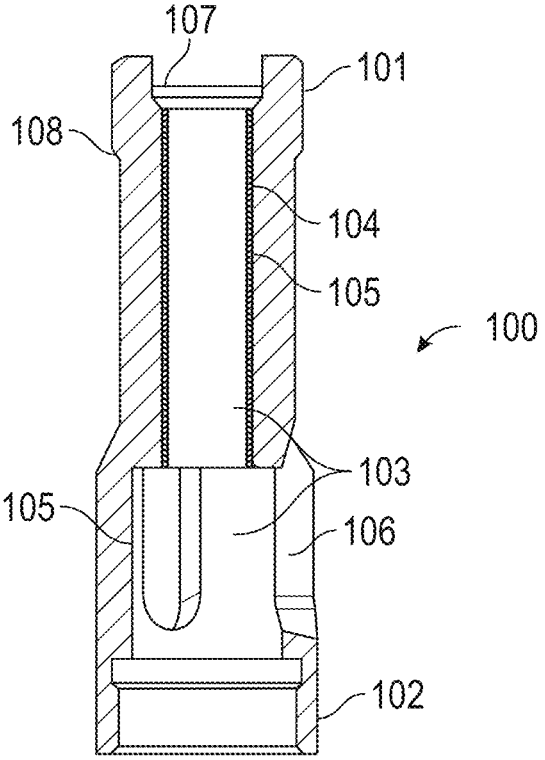
FIG. 2B (Prior Art)
Figure 3A:
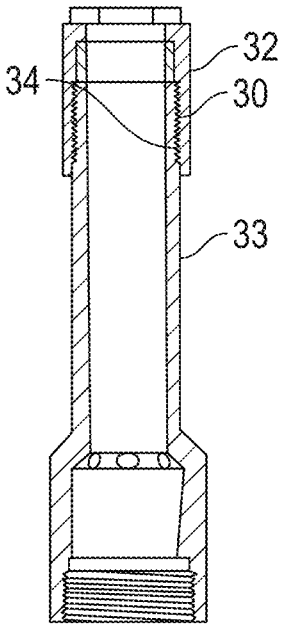
FIG. 3A (Prior Art)
FIGS. 3A and 3B illustrate further examples of conventional valve rod guides utilizing a hardened insert in conjunction with a multi-element valve rod guide.
Figure 3B:
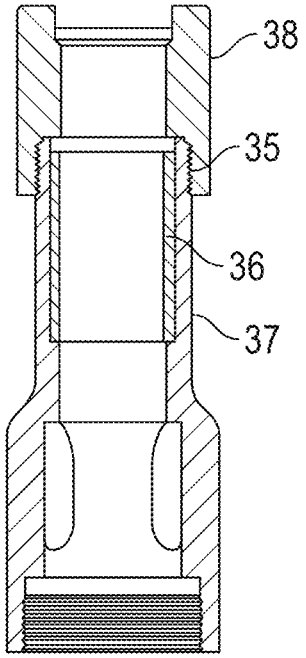
FIG. 3B (Prior Art)
Figure 4:
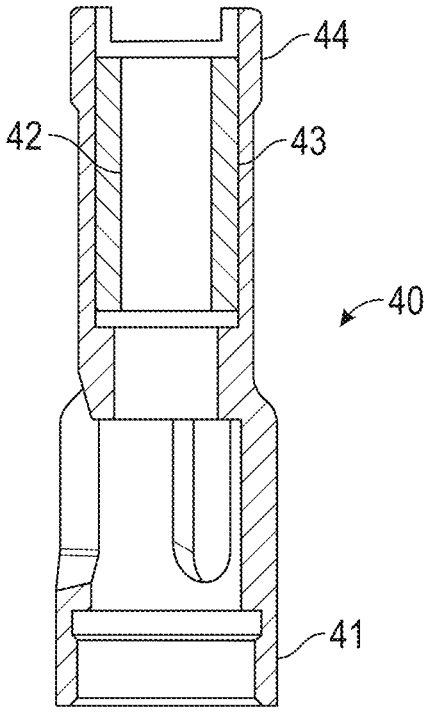
FIG. 4 (Prior Art)
FIG. 4 illustrates a still further conventional valve rod guide in which a hardened insert was fixedly positioned within a single component valve rod guide.

While the inventions disclosed herein are susceptible to various modifications and alternative forms, only a few specific embodiments have been shown by way of example in the drawings and are described in more detail below. The figures and detailed descriptions of these embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts illustrated and taught by the specific embodiments.

DETAILED DESCRIPTION

The Figures described above, and the written description of specific structures and functions below, are not presented to limit the scope of the inventions disclosed or the scope of the appended claims. Rather, the Figures and written description are provided to teach a person skilled in this art to make and use the inventions for which patent protection is sought.

A person of skill in this art having benefit of this disclosure will understand that the inventions are disclosed and taught herein by reference to specific embodiments, and that these specific embodiments are susceptible to numerous and various modifications and alternative forms without departing from the inventions we possess. For example, and not limitation, a person of skill in this art having benefit of this disclosure will understand that Figures and/or embodiments that use one or more common structures or elements, such as a structure or an element identified by a common reference number, are linked together for all purposes of supporting and enabling our inventions, and that such individual Figures or embodiments are not disparate disclosures. A person of skill in this art having benefit of this disclosure immediately will recognize and understand the various other embodiments of our inventions having one or more of the structures or elements illustrated and/or described in the various linked embodiments. In other words, not all possible embodiments of our inventions are described or illustrated in this application, and one or more of the claims to our inventions may not be directed to a specific, disclosed example. Nonetheless, a person of skill in this art having benefit of this disclosure will understand that the claims are fully supported by the entirety of this disclosure.

Those persons skilled in this art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

Further, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the scope of what is claimed.

Reference throughout this disclosure to "one embodiment," "an embodiment," or similar language means that a particular feature, structure, or characteristic described in connection with the embodiment is included in at least one of the many possible embodiments of the present inventions. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The description of elements in each Figure may refer to elements of proceeding Figures. Like numbers refer to like elements in all figures, including alternate embodiments of like elements.

Figure 5:
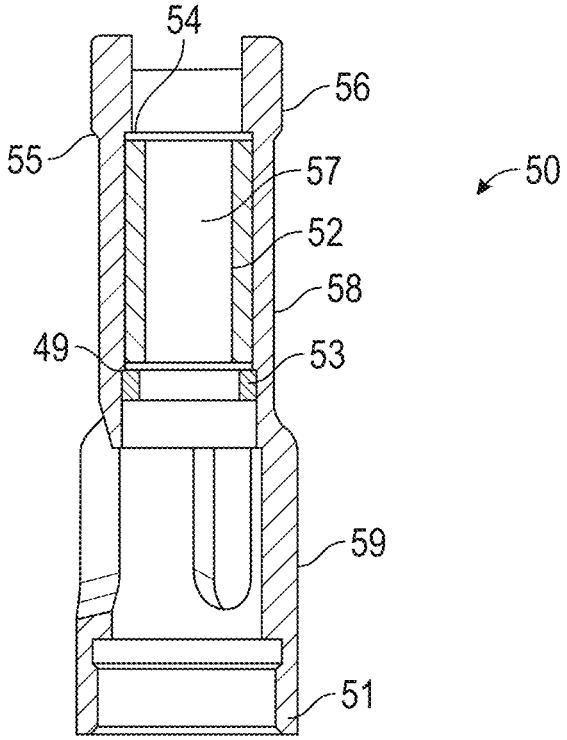
FIG. 5 illustrates aspects of a valve rod guide for use in a pump system formed in accordance with certain teachings of this disclosure.

Turning now to several descriptions, with reference to Figures, of particular embodiments incorporating one or more aspects of the disclosed inventions, FIG. 5, illustrates aspects of an improved robust valve rod guide assembly constructed in accordance with certain teachings of the present disclosure.

Referring first to FIG. 5, in the illustrated is the embodiment of current disclosure of a valve rod guide assembly 50 formed from a unitary rod guide body 51; a slidable insert 52 positioned within the longitudinal bore 57; and a retention element 53 positioned within the unitary rod guide body 51. In the example of FIG. 5, the retention element takes the form of a ring or ring-like structure having a longitudinal length.

In the example of FIG. 5, and other exemplary embodiments constructed in accordance with the teachings of this disclosure, the unitary rod guide body 51 may formed from stainless steel, carbon steel, Monel (or any other suitable materials) using any suitable manufacturing, e.g., machining. While the hardness of the housing can vary, in one exemplary embodiment the maximum hardness of the housing can be on the order of HRB 79 to HRC 23.

In the example of FIG. 5, and other exemplary embodiments constructed in accordance with the teachings of this disclosure, the slidable insert 52 may be formed of tungsten carbide.

In the example of FIG. 5, and other exemplary embodiments constructed in accordance with the teachings of this disclosure, the retention element 53 can be formed from the same materials described above in connection with the unitary rod guide body 51, using the same processes described above in connection with the formation of the unitary rod guide body 51.

As shown in FIG. 5, in the illustrated example, the exterior surfaces of the unitary valve body define an upper clutch section 56, having a first external maximum outer diameter and a first longitudinal length; a longitudinal neck section 58, having a second external maximum outer diameter and a second longitudinal length; and a fluid exit section 59, having a third external maximum outer diameter. In the example of FIG. 5, the third external maximum outer diameter is greater than the first and second external maximum diameters and the first external maximum diameter is greater than the second external maximum diameter. In the example of FIG. 5, the second longitudinal length is greater than the first longitudinal length.

In the example of FIG. 5, the unitary rod guide body 51 further defines various internal bore sections including a first internal bore section within the upper clutch section 56 having a first internal diameter; a second internal bore section within the longitudinal neck section 58, having a second internal diameter, where the second internal diameter is greater than the first internal diameter; and a third internal bore section within the fluid exit section 59 having a third internal diameter, where the third internal diameter is greater than the second internal diameter.

As further shown in FIG. 5, in the illustrated example, the unitary body further defines several internal radially extending edge surface including a first radially extending internal edge surface 54 and a second radially extending internal edge surface 49. As shown in FIG. 5, in the example, the first radially extending internal edge surface 54 is approximately aligned with the transition of the exterior surface of the unitary rod guide body 51 from the upper clutch section 56 and the longitudinal neck section 58. Further, in the example, FIG. 5, the second radially extending internal ledge surface is positioned within the longitudinal throat section 58 of the unitary rod guide body 51.

In the example of FIG. 5, the slidable insert 52 is formed form a hardened material such as carbide, although it will be appreciated that it can be formed of alternate materials.

In the example of FIG. 5, the slidable insert 52 has a maximum outer diameter that is less than the minimum inner diameter of second internal bore within the unitary rod guide body 51 such that the slidable insert 52, when positioned within the unitary body 51 as shown in FIG. 5, can both move longitudinally within the unitary body 51 and, in at least some embodiments, rotate relative to the unitary rod guide body 51. In the example of FIG. 5, the longitudinal movement of the slidable insert 52 is constrained in one direction by the first radially extending edge surface 54, which acts as a positive stop against such movement.

In the example of FIG. 5 the retention element 53 is positioned within the bore defined by the unitary rod guide body such that a first outer surface of the retention element abuts the second radially extending internal edge surface 49. In this manner, in second radially extending internal edge surface 49 inhibits longitudinal movement of the retention element 53. As is further apparent from FIG. 5, in the illustrated embodiment, the retention element defines a surface that extends radially into the internal bore of the unitary body such that it forms a surface that acts as a positive stop against movement of the slidable insert in one direction. As such, a surface of the retention element 53 forms a positive stop that prevents lateral movement of the slidable insert 52 in one direction (downward in FIG. 5). Thus, in the example of FIG. 5, movement of the slidable insert is constrained in one direction by edge surface 54 and in an opposite direction by a surface of the retention element 53.

While the retention element 53 may be formed from any suitable material, in the example of FIG. 5, the retention element is formed from stainless steel.

In FIG. 5, the retention element 53 is fixed in position relative to the unitary rod guide body through a brazing process. Alternative methods of connection, such as friction welding, metallurgically affixing, threading, press fit or by any other known method may be used.

As will be appreciated by those of ordinary skill having access to this disclosure, the configuration depicted in FIG. 5 enables an efficient assembly process. Initially, the slidable insert may be positioned within the unitary rod guide body 51 by feeding into and through the larger open end of the body (i.e., the lower open end of FIG. 5). Next, the retention element 53 can be feed into the body 51 through the same opening until it abuts the radially extending internal surface 49. Then the retention element 53 can be fixed in place through a suitable process as described above.

As reflected in FIG. 5, when the retention element 53 is fixed in position relative to the unitary rod guide body 51, a longitudinal bore section is established that extends from one surface of the retention element 53 (the upper surface in FIG. 5) to the first radially extending internal edge surface 54, where the longitudinal bore section has a longitudinal length that is greater than the longitudinal length of the slidable insert 52. As a result of the difference between the longitudinal length of the slidable insert 52 and the described longitudinal bore section, and the difference between the maximum outer diameter of the slidable insert 52 and the minimum internal diameter of the retention element 53, the slidable insert 52 can—in operation—longitudinally move for a distance along the longitudinal bore section.

This arrangement provides the slidable insert 52 a lateral movement during the reciprocating motion of valve rod (not shown) between a first positive stop provided by the first radially extending internal edge surface 54 and a surface of the retention element 53. The lateral movement can minimize the potential of any damage, e.g., cracking of insert 53 in the event of downhole pump tagging or other shock to the discussed apparatus.

In the example of FIG. 5, the geometry of the body 51 can be machined such that it can accept standard overshot fishing tools for pulling the downhole pump.

Figure 6A:
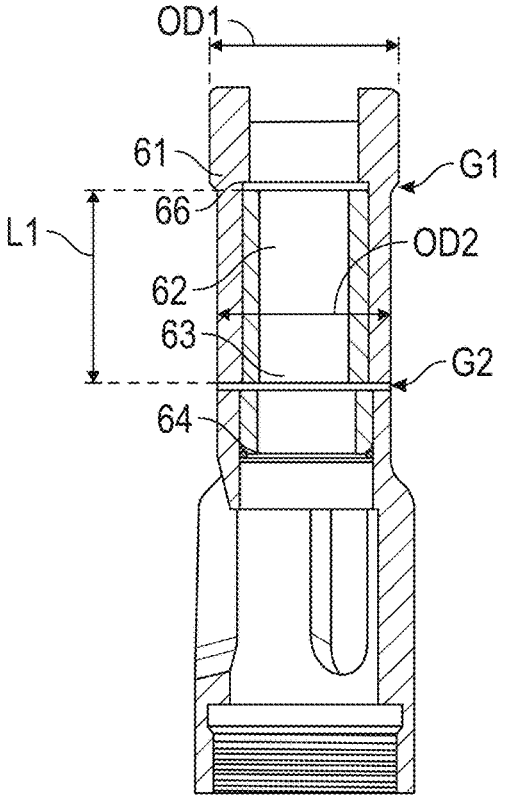
FIGS. 6A and 6B illustrate additional aspects of a valve rod guide for use in a pump system formed in accordance with certain teachings of this disclosure and, in particular, certain exemplary dimensional information.
Figure 6B:
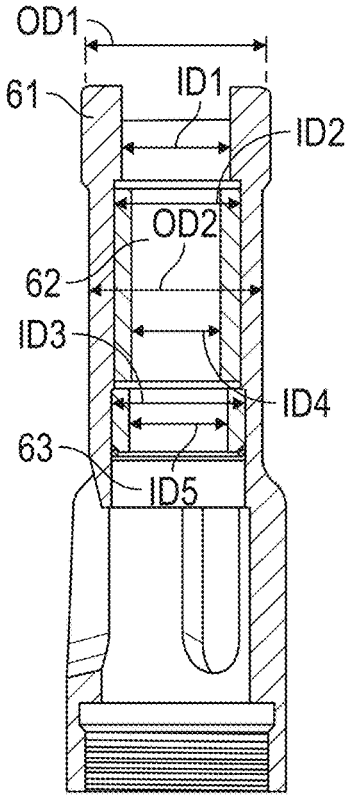

The geometries and sizes of the various elements described above in connection with FIG. 5 can vary from embodiment to embodiment of a valve rod guide assembly constructed in accordance with the teachings of the present disclosure. FIGS. 6A and 6B illustrate exemplary geometries and sizes that may be used to implement certain teachings of the present disclosure.

Referring to FIGS. 6A and 6B, and exemplary valve rod guide assembly is depicted which comprises a which depicts a partial section of an exemplary unitary rod guide body 61, an exemplary slidable insert 62, and an exemplary retaining element 63 held in place, at least in part by, filler material and a braze ring 64. In general, the elements of FIGS. 6A and 6B may be constructed in the general form of, and using the same processes and materials, described herein in connection with corresponding elements of other disclosed embodiments (e.g., those disclosed in FIGS. 5 and 7).

As reflected in FIG. 6A, the unitary rod guide body 61 may define various sections including a first upper section having a first outer diameter OD1 and a second section having a second outer diameter OD2 where the first outer diameter OD1 is greater than the second outer diameter OD2. As shown in FIG. 6B a bore section may be formed within the first upper section having a first internal diameter ID1, a second bore section having a second internal diameter ID2 may be formed within the section second section and a third bore section having a third internal diameter ID3 may also be formed within the second section. In such an example, the second internal diameter ID2 may be greater than the first internal diameter ID1, and the third internal diameter ID3 may be greater than the second internal diameter ID2.

As reflected in FIG. 6A, when the elements are assembled as shown, a longitudinal bore is established that extends from one surface of the retaining element 63 (the upper surface in FIGS. 6A and 6B) to an radially extending internal surface of the body 66. And within this longitudinal bore the slidable insert 62, having a length L1 may be positioned. In the example of FIGS. 6A and 6B, the longitudinal length of the longitudinal bore is greater than the longitudinal length of the insert 62 such that the insert can move longitudinal within the bore. For example, in one embodiment, the slidable insert 62 may have a length of approximately 1.5 inches, and the length of the described longitudinal bore may be 1.562 inches, such that the insert 62 can move longitudinally up to about 0.062 inches (or approximately 4% of the insert's longitudinal length) within the bore. In some embodiments, the insert can move a longitudinal distance that is between 2%-6% of its longitudinal length. As further reflected in FIGS. 6A and 6B, both the insert 62 and the retaining element 63 have a radial thickness. In the illustrated example the radial thickness of the insert is greater than the radial thickness of the retaining element 63.

Figure 7:
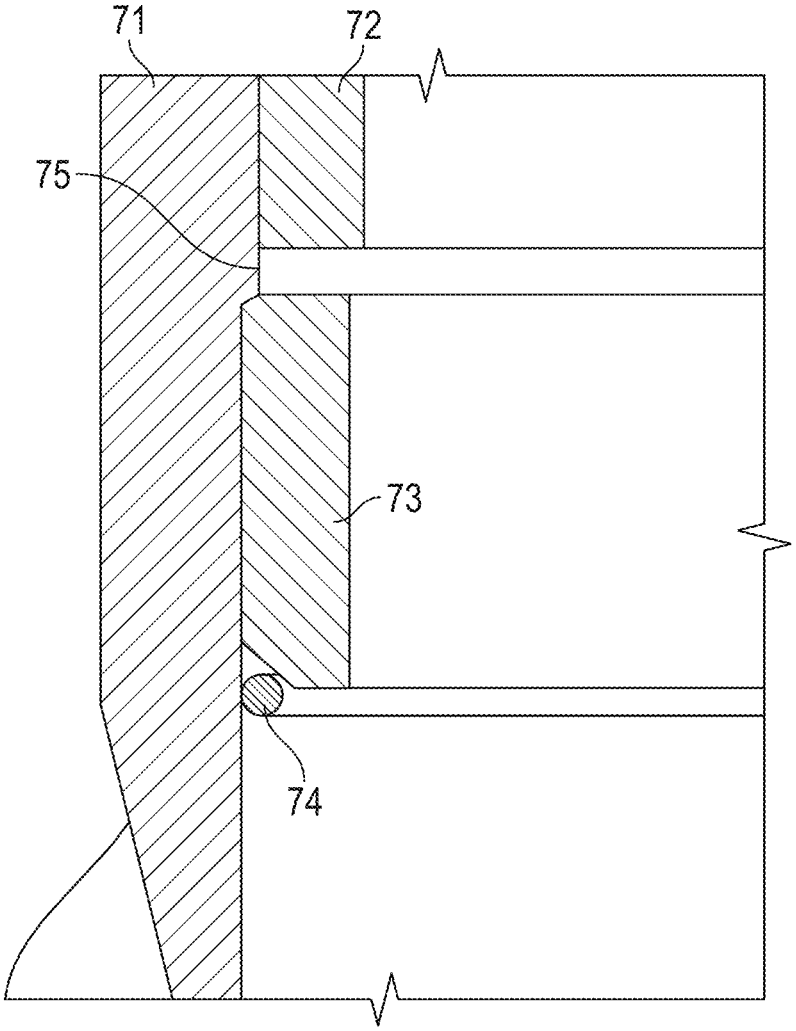
FIG. 7 illustrates an exemplary relationship between a retaining element and a valve rod guide housing constructed in accordance with certain teachings of this disclosure.

In certain embodiments of a valve rod guide assembly constructed in accordance with teachings of this disclosure, the unitary rod guide body can be formed to provide a radially extending surface configured to assist in the positioning and retention of a retention element within the housing. One such example is illustrated in FIG. 7, which depicts a partial section of an exemplary unitary rod guide body 71, an exemplary slidable insert 72, and an exemplary retaining element 73 held in place, at least in part by, filler material and/or a braze ring 74. In general, the elements of FIG. 7 may be constructed in the general form of, and using the same processes and materials, described herein in connection with corresponding elements of other disclosed embodiments (e.g., those disclosed in FIGS. 5, 6A and 6B).

In the example of FIG. 7 the valve housing 71 is formed to have a radially extending ledge surface 75 that provides a positive stop that block longitudinal movement of the retaining element 73 in one direction. In the illustrated example the ledge surface extends radially across at least a portion of the retaining element 73 and, in the example of FIG. 7, extent of the radial overlap between the ledge surface 75 and the retaining element 73 is approximately 0.024 of an inch.

As reflected in FIG. 7, and although only a portions of the depicted elements are shown, it will be appreciated by those of sill in the art that, in the illustrated example of FIG. 7: (1) the inner diameter of the retaining element 73 is greater than the inner diameter of the slidable member 72 and (2) the radial thickness of the hardened insert 72 is greater than the radial thickness of the retaining element 73. While the dimensions of the described inner diameters can vary from embodiment to embodiment, in one exemplary embodiment, the inner diameter of the retaining element can be on the order of 0.8125 inches and the inner diameter of the hardened insert can be on the order of 0.700 inches. Similarly, while the radial thicknesses of the described element can vary from embodiment to embodiment, in one exemplary embodiment the radial thickness of the retaining element 73 can be on the order of approximately 0.125 inches and the radial thickness of the hardened insert 72 can be between on the order of between approximately 0.150 and 0.213 inches.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed:

1. A valve rod guide assembly for use in a sucker-rod artificial lift system comprising:

a unitary rod guide body, the unitary rod guide body defining a longitudinal bore passing therethrough, the longitudinal bore further defining a first section having a first internal diameter, a second section having a second internal diameter, and a third section having a third internal diameter, wherein the second internal diameter is greater than the first internal diameter and the third internal diameter is greater than the second internal diameter, the unitary rod guide body further comprising a first radially extending internal edge surface and a second radially extending internal edge surface;

a slidable insert positioned within the second section of the longitudinal bore, wherein the maximum outer diameter of the slidable insert is less than the minimum internal diameter of the second section of the longitudinal bore, such that the slidable insert is capable of moving longitudinally within the second section of the longitudinal bore, the longitudinal movement of the slidable insert being constrained in a first direction by the first radially extending internal edge surface; and a retention element positioned within the third section of the longitudinal bore in such a manner that relative movement between the retention element and the longitudinal bore is inhibited, the retention element being positioned such that longitudinal movement of the slidable insert in a second direction is constrained by a surface of the retention element.

2. The valve rod guide assembly of claim 1 wherein the unitary rod guide body comprises steel.

3. The valve rod guide assembly of claim 2 wherein the unitary rod guide body is formed through a machining operation.

4. The valve rod guide assembly of claim 1 wherein the slidable insert comprises tungsten carbide.

5. The valve rod guide assembly of claim 1 wherein the retention element is formed from the same material as the unitary rod guide body.

6. The valve rod guide assembly of claim 1 wherein a surface of the retention element abuts the second radially extending internal edge surface.

7. The valve rod guide assembly of claim 6 wherein the retention element is affixed to the unitary rod guide body by brazing.

8. A valve rod guide assembly comprising:

a unitary body, the unitary body defining a longitudinal bore passing therethrough, the longitudinal bore further defining a first internal section having a first internal diameter, a second internal section having a second internal diameter, and a third internal section having a third internal diameter, wherein the second internal diameter is greater than the first internal diameter and the third internal diameter is greater than the second internal diameter, the unitary body further defining a first outer section having a first outer diameter and a first longitudinal length, a second outer section having a second outer diameter and a second longitudinal length, and a third outer section having a third outer diameter and a third longitudinal length, wherein the first outer diameter is greater than the second outer diameter and wherein the second longitudinal length is greater than the first longitudinal length;

an insert positioned within the second internal section of the longitudinal bore, wherein the insert is capable of moving longitudinally within the second internal section of the longitudinal bore, and wherein the longitudinal movement of the insert is constrained in a first direction by a feature of the unitary body; and a ring affixed to the unitary body within the third internal section of the longitudinal bore, the ring being positioned such that longitudinal movement of the insert in a second direction is constrained by the ring.

9. The valve rod guide assembly of claim 8 wherein the first outer section defines a clutch section and wherein the clutch section is configured to accept a fishing tool.

10. The valve rod guide assembly of claim 8 wherein the insert is positioned within the second outer section of the unitary body.

11. The valve rod guide assembly of claim 10 wherein the ring is positioned within the second outer section of the unitary body.

12. The valve rod guide assembly of claim 8 wherein the unitary body defines an edge surface that is configured to act as a positive stop preventing longitudinal movement of the ring in the first direction.

13. The valve rod guide assembly of claim 8 wherein the insert defines an insert internal diameter and the ring defines a ring internal diameter, and wherein the insert internal diameter of the insert is less than the ring internal diameter.

14. The valve rod guide assembly of claim 13 wherein the insert has a first radial thickness and the ring has a second radial thickness, and wherein the first radial thickness is greater than the second radial thickness.

15. A rod guide assembly comprising:

a main body formed form a single piece of machined metal, the main body having a longitudinal axis and an radial axis that is perpendicular to the longitudinal axis, the main body being machined such that the main body defines a longitudinal bore extending along the longitudinal axis, and a first edge surface extending radially into the longitudinal bore and a second edge surface extending into the longitudinal bore;

a ring-like retaining element positioned within a portion of the longitudinal bore, the ring-like retaining element comprising a surface abutting the second edge surface, the ring-like retaining element defining an upper surface; and an insert in the form of a tube that is positioned within the longitudinal bore in such a manner that the insert is movable, wherein movement of the insert in a first longitudinal direction is constrained by the first edge surface of the main body and movement of the insert in a second longitudinal direction is constrained by the upper surface of the ring-like retaining element.

16. The rod guide assembly of claim 15 wherein the ring-like retaining element is press fit into the main body.

17. The rod guide assembly of claim 15 wherein the insert has a longitudinal length, and wherein movement of the insert is constrained such that the insert can move at least 2% of, and not more than about 6% of, the longitudinal length of the insert.

18. The rod guide assembly of claim 15 wherein the insert has an insert inner diameter and an insert radial thickness and the ring-like retaining element has a ring inner diameter and a ring radial thickness, and wherein the ring inner diameter is greater than the insert inner diameter, and the insert radial thickness is greater than the ring radial thickness.

19. The rod guide assembly of claim 15 wherein the insert is formed from hardened steel.

20. The rod guide assembly of claim 15 wherein the insert has a longitudinal length and the ring-like retaining element has a longitudinal length and the longitudinal length of the insert is greater than the longitudinal length of the ring.

* * * * *